US006978741B2

(12) United States Patent
Kemp et al.

(10) Patent No.: US 6,978,741 B2
(45) Date of Patent: Dec. 27, 2005

(54) APPARATUS AND METHOD FOR MEASURING TOTAL DISSOLVED SOLIDS IN A STEAM BOILER

(75) Inventors: Brendan Kemp, Kent (GB); Paul James Nichols, Kent (GB)

(73) Assignee: Autoflame Engineering Limited, London (GB)

( * ) Notice: Subject to any disclaimer, the term of this patent is extended or adjusted under 35 U.S.C. 154(b) by 0 days.

(21) Appl. No.: 10/887,105

(22) Filed: Jul. 8, 2004

(65) Prior Publication Data

US 2005/0224016 A1 Oct. 13, 2005

(30) Foreign Application Priority Data

Apr. 8, 2004 (GB) ..... 0408102

(51) Int. Cl.[7] ..... F22D 5/00
(52) U.S. Cl. ..... 122/448.1; 122/447
(58) Field of Search ..... 122/448.1, 447, 122/448.2, 504

(56) References Cited

U.S. PATENT DOCUMENTS

| | | | | |
|---|---|---|---|---|
| 4,285,302 A | | 8/1981 | Kelly et al. | |
| 4,437,968 A | * | 3/1984 | Elliott, Jr. | 204/600 |
| 4,465,026 A | * | 8/1984 | Carberry | 122/382 |
| 4,830,757 A | * | 5/1989 | Lynch et al. | 210/742 |
| 4,938,174 A | * | 7/1990 | Bennett | 122/382 |
| 4,940,667 A | * | 7/1990 | Goldstein et al. | 436/157 |
| 5,152,252 A | * | 10/1992 | Bolton et al. | 122/401 |
| 6,582,563 B1 | * | 6/2003 | Adam et al. | 202/83 |
| 6,655,322 B1 | | 12/2003 | Godwin et al. | |
| 2003/0226794 A1 | | 12/2003 | Coke | |

FOREIGN PATENT DOCUMENTS

| | | |
|---|---|---|
| EP | 0 398 070 A2 | 11/1990 |
| GB | 1 368 067 A | 9/1974 |
| GB | 0 340 977 A2 | 11/1989 |
| GB | 2 374 135 | 10/2002 |
| JP | 2000-243107 A | 8/2002 |

* cited by examiner

*Primary Examiner*—Gregory A. Wilson
(74) *Attorney, Agent, or Firm*—Merchant & Gould P.C.

(57) ABSTRACT

A method and apparatus for controlling the operation of a pressurized steam boiler heated by a burner. The method includes the steps of monitoring the level of total dissolved solids in water contained in the boiler, monitoring the level of water in the boiler, monitoring the pressure of steam in the boiler, monitoring the firing rate of the burner; controlling the blow down of the boiler having regard to the level of total dissolved solids in water contained in the boiler, and controlling the flow rate of water into the boiler and the firing rate of the burner. All input signals relating to the monitoring steps are passed to a common control unit and all output signals relating to the controlling steps are transmitted from the common control unit.

43 Claims, 3 Drawing Sheets

FLUE
31
37
23
74
73A
73
47
38
55
72
54
53
59
50
52
22
71A
71
62
70
61
21
40
28
29
46
27
44
45
20
26
41
2
3
5

APPARATUS AND METHOD FOR MEASURING TOTAL DISSOLVED SOLIDS IN A STEAM BOILER

FIELD OF THE INVENTION

The invention relates to steam boilers and their control, and more particularly to a method and apparatus for measuring the total dissolved solids in the water of a steam boiler.

BACKGROUND OF THE INVENTION

In a known arrangement of a steam boiler, water is fed into the boiler at a controlled rate and is heated in the boiler to convert the water to steam. The heat required to convert the water to steam is provided by a burner whose hot products of combustion are passed through ducts in the boiler and then exhausted. The steam boiler is controlled by a boiler control system, which receives information from sensors indicating, inter alia, the level of water in the boiler and the pressure of steam in the boiler, and which controls the flow rate of water into the boiler as well as sending a control signal to a burner control system that controls the burner. The burner control system controls, inter alia, the flow of fuel and gas to the burner head in dependence upon a demand signal received from the boiler.

The water that is fed in to the boiler will, even when pre-treated, generally contain some solids in solution. The steam boiler increases the concentration of the solution through the evaporation of steam. If the level of total dissolved solids is increased, precipitate begins to form on surfaces within the boiler, leading to premature boiler failure, slower heat exchange rates and a reduction in the efficiency of the steam boiler.

One factor that may be taken into account to ensure the steam boiler functions efficiently is the level of total dissolved solids in the water, which should be maintained below a predetermined and preselected maximum level. The level of dissolved solids may be reduced by blowing down the steam boiler. During blow down the concentrated boiler water is partly replaced by feed water. Blowing down the boiler frequently can keep the average total dissolved solids well below the predetermined maximum, but heat is lost with the water discharged from the steam boiler and the efficiency of the steam boiler is reduced. More efficient operation can be obtained by blowing down the steam boiler to maintain the average level of total dissolved solids at a value almost equal to the preselected maximum value.

BRIEF SUMMARY OF THE INVENTION

It is an object of the invention to provide an improved method and apparatus for controlling the operation of a steam boiler and reducing or avoiding any unnecessary blow down of the boiler.

According to the invention there is provided a method of controlling the operation of a pressurised steam boiler heated by a burner, the method including the following steps:

a) monitoring the level of total dissolved solids in water contained in the boiler,
b) monitoring the level of water in the boiler,
c) monitoring the pressure of steam in the boiler,
d) monitoring the firing rate of the burner,
e) controlling blow down of the boiler having regard to the signals resulting from a), f) controlling the flow rate of water into the boiler, and
g) controlling the firing rate of the burner, all input signals relating to the monitoring steps being passed to the common control unit and all output signals relating to the controlling steps being transmitted from the common control unit.

By combining the control of the boiler and burner in the manner defined above, it becomes possible to provide a very efficient method for controlling the level of total dissolved solids in the water.

The step of controlling the firing rate of the burner may include controlling the fuel flow and may also include controlling the air flow. The air flow may be controlled by adjusting the position of an air damper and/or by adjusting the speed of a fan that generates the air flow into the burner.

Preferably the amount of blow down of the boiler is controlled according to the firing rate of the burner. The rate of generation of total dissolved solids is proportional to the evaporation rate of water from the boiler and is therefore approximately proportional to the firing rate of the burner. It is therefore preferable that the amount of blow down of the boiler is controlled approximately in proportion to the firing rate of the burner. The amount of blow down may be altered by altering the length of the blow down but is preferably altered by altering the standard time interval between blow downs.

It is also preferable that during the initial heating of the water in the boiler to its operating temperature and pressure, no blow down is carried out since that would only delay the running up of the boiler to its steady state running condition. Thus it is preferred that blow down of the boiler is inhibited until the pressure of steam in the boiler reaches a predetermined level.

In accordance with an especially preferred feature of the invention, the step of monitoring the level of total dissolved solids in water in the boiler includes the step of measuring the temperature of the water contained in the boiler, and assessing the level of total dissolved solids having regard to the temperature of the water in the boiler. If such a method is used, it is possible to make the measurement of total dissolved solids online since there is no need to cool the water first to a standard temperature.

Whilst there are a variety of ways of measuring total dissolved solids in water, it is preferred that the measurement is made principally by measuring the conductivity (the electrical conductivity) of a sample of water in the boiler. Such a method of measuring total dissolved solids is already known per se. In accordance with an especially preferred feature of the invention, the conductivity of the water is measured using pulses of electrical energy that are emitted only for a proportion of the time during which the conductivity measurement is being made. By adopting such a pulsed system, build-up of polarisation of the water sample is to a large extent avoided. Preferably the pulses include both positive and negative pulses and more preferably the pulses are of alternating polarity. In order to further reduce the build-up of polarisation, the pulses are preferably emitted for less than 10%, and most preferably for less than 1%, of the time during which the conductivity measurement is being made. In a preferred embodiment of the invention, the pulses are emitted for only 0.6% of the time.

According to another especially preferred feature of the invention, the step of monitoring the level of total dissolved solids in water in the boiler includes the step of measuring the degree of polarisation of the sample of water whose conductivity is measured and taking the polarisation measurement into account in the assessment of the level of total dissolved solids. By making an adjustment to allow for the degree of polarisation, it becomes possible to obtain a more accurate measurement of the level of total dissolved solids.

Although it is within the scope of the invention to monitor the total dissolved solids of a sample of water while that sample is contained within the boiler, it is preferred that the step of monitoring the level of total dissolved solids in water contained in the boiler includes the step of removing a sample of water from the boiler. Preferably, water is removed from the boiler and passed along a conduit through a water sampling probe assembly. The water sampling probe assembly may receive water from any part of the boiler but preferably receives surface blow down water. "Surface blow down water" is hereby defined as water taken from closer to the top surface of the water than to the bottom of the boiler.

According to another especially preferred feature of the invention, water flow through the water sampling probe assembly is turbulent and effects a cleaning action on the water sampling probe assembly. Such an arrangement is advantageous in that it promotes reliable measurements of total dissolved solids in the long term. It is also preferred that when water is removed from the boiler to reduce the level of total dissolved solids, it is passed through the water sampling probe assembly. This enhances the cleaning action.

Preferably, the measuring tip of the probe assembly is located in a region where the cross-sectional area of the water flow path is reduced. Such an arrangement enhances the turbulence of the water in the region of the measuring tip. The cross-sectional area of the water flow path may be reduced by an apertured plate provided across the water flow path. The measuring tip of the probe may be provided in the region of an aperture in the plate or may be spaced from any aperture in the plate.

Preferably the assessment of the level of total dissolved solids is made having regard to the measurement of the pressure of steam in the boiler.

In response to an indication that the level of total dissolved solids in the water contained in the boiler exceeds a predetermined maximum value, a boiler blow down sequence is preferably commenced.

The level of total dissolved solids in the water contained in the boiler is preferably monitored periodically.

According to the invention there is also provided a pressurised steam boiler including a boiler housing for containing water in a boiler, a burner for heating water in the boiler and converting the water into steam, a total dissolved solids detector for monitoring the level of total dissolved solids in the water in the boiler, a water level detector for monitoring the level of water in the boiler, a pressure detector for detecting the pressure of steam in the boiler, a firing rate detector for detecting the firing rate of the burner, and a common control unit which receives input signals from the total dissolved solids detector, the water level detector, the pressure detector and the firing rate detector, and is operative to control the flow rate of water into the boiler, blow down of the boiler and the firing rate of the burner in dependence upon said input signals.

The pressurised steam boiler may further include features suited to carrying out any of the preferred features of the method defined above.

Whilst the method and boiler of the invention are preferably provided in the context of a common control unit, as indicated above, the especially preferred features of the invention referred to above may also, in accordance with the invention, be applied in other arrangements which may not necessarily employ a common control unit. Thus there are the further aspects of the invention set out below.

According to a further aspect of the invention, there is provided a method of controlling the operation of a pressurised steam boiler heater by a burner, the method including the following steps:

(a) measuring the conductivity of water contained in the boiler, (b) measuring the temperature of water contained in the boiler, and (c) assessing the level of total dissolved solids in the water having regard to the results of the conductivity and temperature measurements.

According to a still further aspect there is provided a method of controlling the operation of a pressurised steam boiler heated by a burner, the method including the following steps:

(a) measuring the conductivity of water contained in the boiler, and (b) assessing the level of total dissolved solids having regard to the results of the conductivity measurement, wherein the conductivity of the water is measured using pulses of electrical energy that are emitted only for a proportion of the time during which the conductivity measurement is being made.

According to a still further aspect of the invention there is provided a method of controlling the operation of a pressurised steam boiler heated by a burner, the method including the following steps:

(a) measuring the conductivity of water contained in the boiler, (b) measuring the degree of polarisation of the water whose conductivity is measured, and (c) assessing the level of total dissolved solids having regard to the conductivity and polarisation measurements.

According to a still further aspect of the invention there is provided a method of controlling the operation of a pressurised steam boiler heated by a burner, the method including the following steps:

(a) providing a water sampling probe assembly for measuring total dissolved solids, the probe assembly being connected to receive water contained in the boiler via a conduit, (b) passing water from the boiler through the water sampling probe assembly, and (c) using the water sampling probe assembly to measure the conductivity of the water passing through the assembly, wherein the water flow through the water sampling probe assembly is turbulent and effects a cleaning action on the water sampling assembly.

The methods defined above and according to other aspects of the invention may of course, wherever appropriate, employ any of the features already defined with respect to the first-mentioned aspect of the invention.

Similarly, there is provided according to a further aspect of the invention a pressurised steam boiler including:

a boiler housing for containing water in a boiler, a burner for heating water in the boiler and converting the water into steam, a conductivity detector for measuring water conductivity, and a temperature detector for detecting the temperature of the water contained in the boiler, wherein the signal from the conductivity detector is arranged to be modified in dependence upon the temperature measurement to provide an indication of the total dissolved solids in the water.

According to a still further aspect of the invention there is provided a pressurised steam boiler including:

a boiler housing for containing water in a boiler, a burner for heating water in the boiler and converting the water into steam, and a conductivity detector for measuring water conductivity, wherein the conductivity detector is arranged to emit pulses of electrical energy only for a proportion of the time during which the conductivity measurement is being made.

According to a still further aspect of the invention there is provided a pressurised steam boiler including:

a boiler housing for containing water in a boiler, a burner for heating water in the boiler and converting the water into steam, a conductivity detector for measuring water conductivity, and a polarisation detector for measuring the degree of polarisation of the water whose conductivity is to be measured, wherein the signal from the conductivity detector is arranged to be modified independence upon the polarisation measurement to provide an indication of total dissolved solids in the water.

According to a still further aspect of the invention there is provided a pressurised steam boiler including:

a boiler housing for containing water in a boiler, a burner for heating water in the boiler and converting the water into steam, and a water sampling probe assembly connected to the interior of the boiler housing by a conduit for measuring the total dissolved solids of water contained in the boiler, wherein the water flow through the water sampling probe assembly is arranged to be turbulent and to effect a cleaning action on the water sampling probe assembly.

The apparatus defined above and according to other aspects of the invention may of course, wherever appropriate, employ any of the features already referred to with respect to the first-mentioned aspect of the invention.

The method and apparatus of the invention may also incorporate any of the features of the steam boiler and its method of operation that are described in WO 02/079695, the contents of which are incorporated herein by reference.

BRIEF DESCRIPTION OF THE SEVERAL VIEWS OF THE DRAWINGS

By way of example, an embodiment of the invention will now be described with reference to the accompanying drawings, of which.

DETAILED DESCRIPTION OF THE INVENTION

Figure 1:
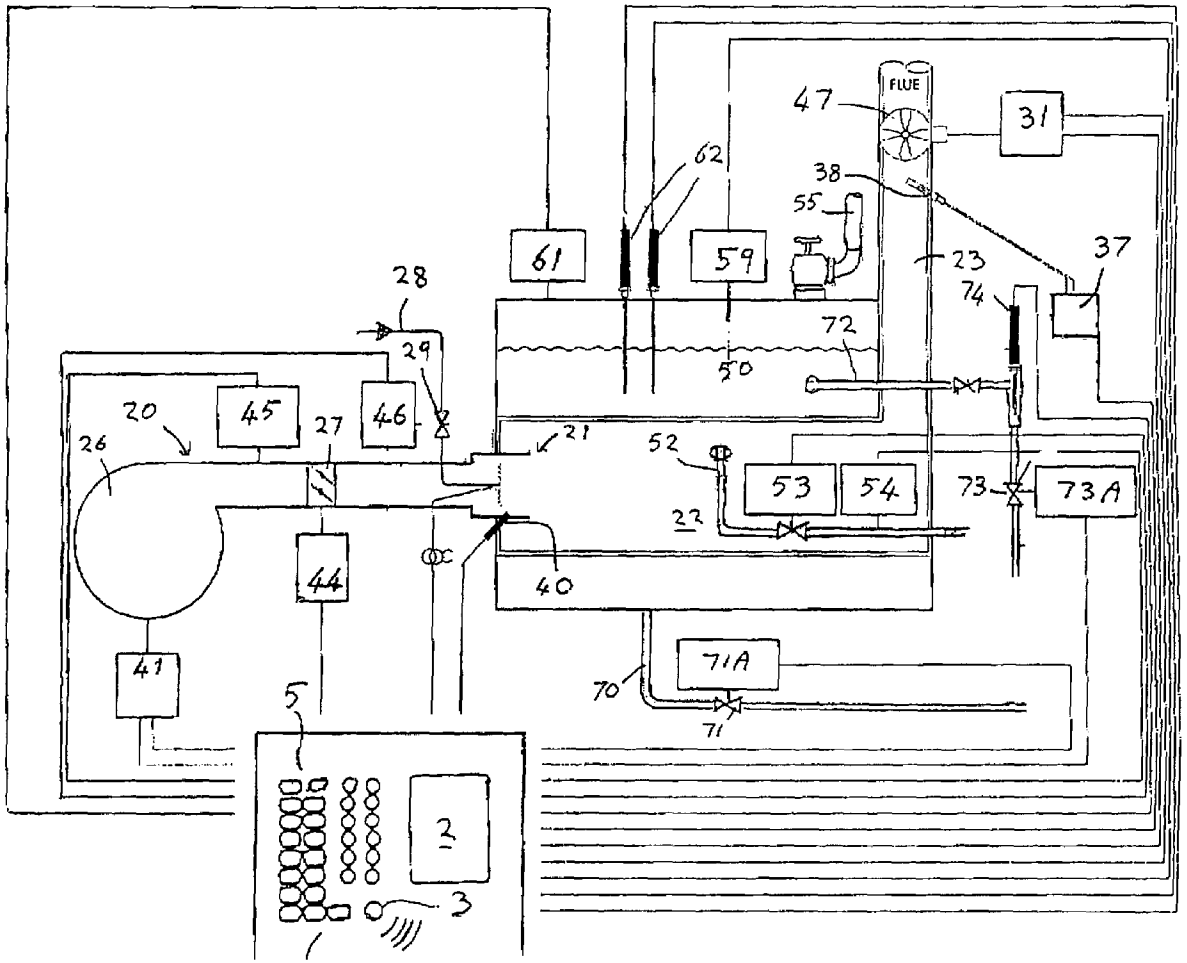
FIG. 1 is a schematic drawing of a burner and a pressurised steam boiler and of a control unit for controlling the burner and steam boiler.

Referring first to FIG. 1, there is shown a burner 20 having a burner head 21, a combustion chamber 22 and a duct 23 for combustion products which comprise exhaust gases. As will be described below the duct 23 passes through a pressurized steam boiler 50; thereafter the exhaust gases are vented through a flue.

Air is fed to the burner head 21 from an air inlet, through a centrifugal fan 26 and then through an outlet damper 27. The burner head 21 is able to operate with either gas or oil as the fuel; gas or oil is fed to the burner head from along a line 28 and via a valve 29.

A control unit 1 is provided for controlling the operation of the burner and boiler. The control unit 1 is provided for controlling the operation of the burner and boiler. The control unit 1 has a display 2, optionally a proximity sensor 3 for detecting that a person is nearby, and a set of keys 5 enabling an operator to enter instructions to the control unit. The purpose of the proximity sensor is not relevant to the present invention and will not be described further herein; its purpose is described in GB2335736A, the description of which is incorporated herein by reference.

The control unit 1 is connected to various sensing devices and drive devices, as shown in the drawing. More particularly the unit is connected via an exhaust gas analyser 37 to an exhaust gas analysis probe 38 (which includes a temperature sensor), and to a flame detection unit 40 at the burner head. The control unit 1 is also connected via a variable speed drive control 41 to the motor of the fan 26 (with control unit 41 receiving a feed back signal from a tachometer associated with the fan 26), via an air servo motor 44 to the air outlet damper 27, to an air pressure sensing device 45 provided in the air supply duct, via a fuel servo motor 46 to the fuel valve 29, and via a variable speed device 31 to a fan 47 in the flue.

Also, in the embodiment of FIG. 1, the boiler 50 is provided with a steam outlet pipe 55, a water inlet pipe 52 which feeds water into the boiler via a feedwater valve 53 controlled by a servo 54. A temperature detector 59 senses the temperature of the water in the boiler (by measuring the temperature of the steam which indicates the temperature of the water once the boiler is up to its running temperature range). The pressure of the steam in the boiler is sensed by a pressure detector 61 and a pair of capacitance probes 62 monitor the level of the water in the boiler. The control unit 1 is connected to the feedwater valve servo 54, the temperature detector 59, the pressure detector 61 and the pair of capacitance probes 62. Other monitoring and control devices may also be provided and connected to the control unit 1.

In general, the arrangement described above is the same as that described in more detail in WO 02/079695, the contents of which is incorporated herein by reference.

Of particular relevance to the present invention, is an outlet pipe 70 at the bottom of the boiler having an associated motorised valve 71 controlled by the control unit 1 for effecting bottom blow down of the boiler and another outlet pipe 72 towards the top of the boiler but below the minimum water level maintained in the boiler, the outlet pipe 72 having an associated motorised valve 73 controlled by the control unit 1 for effecting surface blow down of the boiler.

As will be described in more detail below, a probe 74 for measuring total dissolved solids (TDS) and referred to hereafter as a TDS probe is associated with the outlet pipe 72. The control unit 1 receives signals from the TDS probe and controls the operation of the motorised valves 71 and 73 via servos 71*a* and 73*a*.

The combustion chamber 22 of the burner 20 is arranged inside the boiler 50 in a conventional manner. In FIG. 1 the boiler 50 is shown schematically. Although FIG. 1 suggests that the combustion chamber leads directly to the exhaust duct 23, it will be understood by those skilled in the art that in practice the gaseous products of combustion follow a serpentine path passing through the boiler 50 a few times before reaching the exhaust duct 23 and being exhausted to atmosphere.

Figure 2:
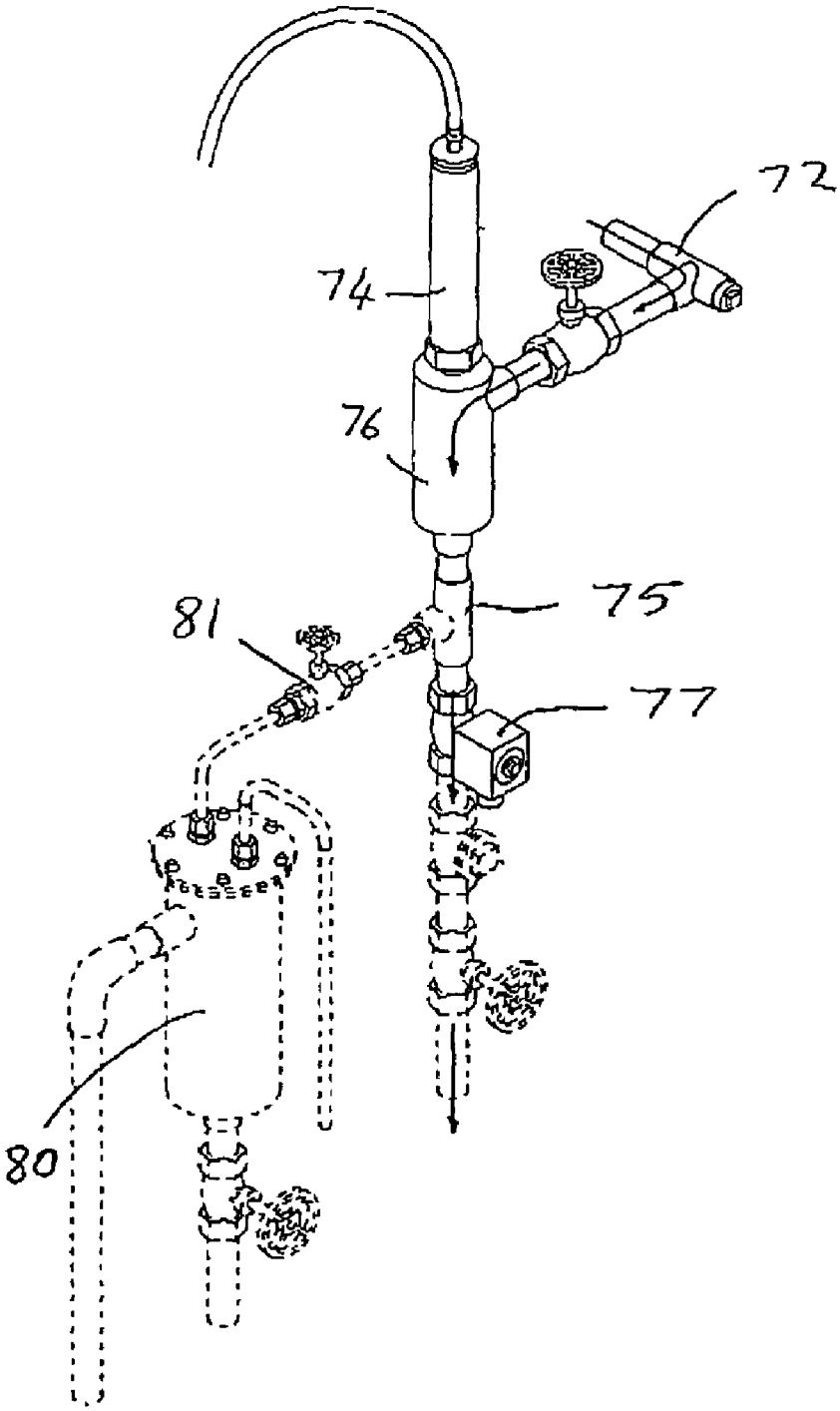
FIG. 2 is a perspective view of an installation of a water sample probe assembly for use in the present invention.
Figure 3:
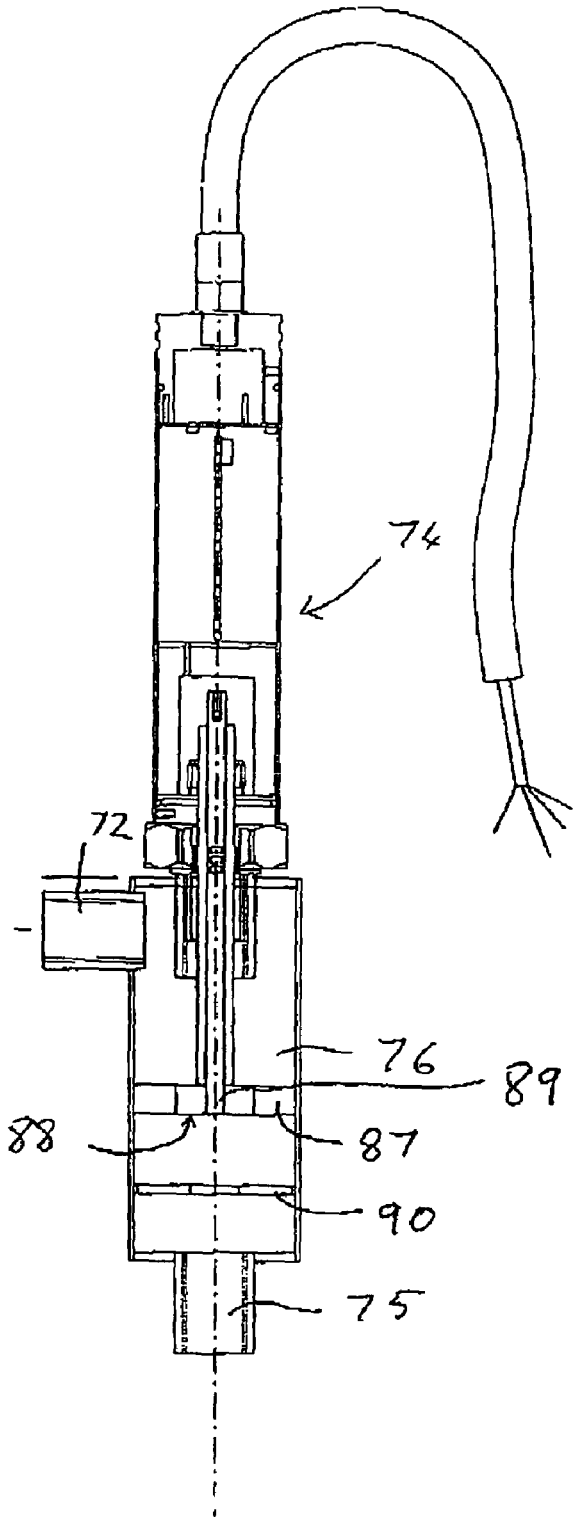
FIG. 3 is a sectional view of the water sample probe assembly of FIG. 2.

Referring now to FIGS. 2 and 3, the outlet pipe 72 is connected via an isolation valve to the top of an interior chamber 76 of the TDS probe 74. The chamber 76 has an outlet pipe 75 at its bottom which is opened and closed by a solenoid valve 77 (the equivalent to the valve 73 and servo 73*a* in FIG. 1) controlled by the control unit 1. The outlet pipe 75 leads to a drain. A plate 87 extends across the chamber 76 and has an orifice 88 in its centre. The measuring tip 89 of the probe projects downwardly into the middle of the orifice 88. Below the plate 87, a baffle plate 90 is provided, the baffle plate 90 having four apertures equiangularly spaced around the centre of the plate.

Also shown in dotted outline in FIG. 2 is a sample cooler 80 which may be connected via a valve 81 to the outlet pipe 75 to receive surface blow down water from the boiler. Such a device may be used to calibrate the TDS probe 74 as will be described later.

The TDS probe 74 may operate in a manner known per se by measuring the electrical conductivity of water passing through the probe. Thus the control unit 1 may, for example, be arranged to feed surface blow down water through the TDS probe periodically (typically once every one to five minutes) and for a period of time selected by the user (typically 3 to 10 seconds) in order to measure the total dissolved solids. A preferred feature of the invention is that in the event that the total dissolved solids measurement indicates a level of solids above a maximum predetermined level, a top blow down of the boiler is carried out by the control unit 1. The duration of that blow down is at the selection of the user but would usually be longer than the duration of the blow down for the purposes of sampling. Typically, the duration would be in the range of 5 seconds to 5 minutes.

The rate of sampling of the total dissolved solids in the water can also be set in the control unit by a user and would typically be set to a rate in the range of one sample every one to five minutes. The actual standard rate of sampling is varied by the control unit 1 in proportion to the firing rate of the boiler, which is also controlled by the control unit 1. If the firing rate of the boiler is at maximum then the standard rate of initiating a top blow down is also at a maximum. If for example the firing rate is halved, then the time interval between top blow downs is doubled. In this way it is possible to avoid unduly frequent or large blow downs at low firing rates of the boiler. Such blow downs would be wasteful of energy used to heat the water. The control unit 1 is also arranged to sample the water again immediately after any surface blow down that has been carried out and detected too high a level of total dissolved solids. Furthermore, when the water in the boiler is first being heated to its steady state operating condition, the control unit is arranged not to effect any blow down and therefore not to slow down the heating of the water. The pressure detector 61 measures the pressure of steam in the boiler and that pressure measurement is used to inform the control unit 1 as to whether the boiler is within its steady state range of operating conditions. If the pressure detected is below that range blow down is prevented.

In accordance with especially preferred features of the invention, the system is arranged to make a more accurate measurement of total dissolved solids in the water, by virtue of the following.

Firstly, the control unit 1 makes use of the temperature measurement of the water in the boiler, as measured by the detector 59, to adjust the conductivity measurement made by the TDS probe 74 and therefore obtain a truer reading. More specifically, for every 1° C. of increase in temperature the conductivity measurement is reduced by 2 percent to give a truer value, and vice versa.

Secondly, steps are taken to reduce polarisation of the water sample whose conductivity is being measured. Instead of passing electrical energy continuously through the probe, the energy is pulsed with there being 10 pulses, each of 300 $\mu$S duration, each second. Thus the amount of electrical energy is reduced to just 0.6% of the amount that would be used if the energy were supplied continuously during sampling. Separate readings of total dissolved solids are obtained from each of the 10 pulses and the average of those results is then taken as the reading. The system is arranged to take the last ten such readings and average them to arrive at a fixed value so that any one measurement from one pulse only contributes one percent of the final reading. Furthermore, the polarity of the pulses is alternated so that again polarisation is reduced. In a particular sample of the invention the pulses are ±0.5 volts and the current measurement is of the order of milliamps.

Thirdly, in addition to reducing the amount of polarisation, an adjustment of the conductivity measurement is made according to any remaining degree of polarisation. At the commencement of each measurement cycle, the probe 74 measures any build up of voltage potential in the water sample and modifies the conductivity calculation accordingly. In a particular example of the invention, one complete measurement cycle comprises the following sequence: a voltage check for 0.3 milliseconds to check the polarisation of the sample; an interval of 0.7 milliseconds; a voltage pulse of +0.5 volts for 0.3 milliseconds to allow a first conductivity measurement; an interval of 0.7 milliseconds; a voltage pulse of −0.5 volts for 0.3 milliseconds to allow a record conductivity measurement; and an interval of 0.7 milliseconds. Thus one measurement cycle occupies 3 milliseconds. Every one second a new conductivity reading is obtained by averaging the last ten measurements which are spread over a one second time interval.

Fourthly, steps are taken to avoid a build up of scale on the probe electrode. The interior chamber 76 of the probe assembly is designed so that the turbulence created by the water during blow down cleans the measuring tip 89 of the probe 74. The positioning of the tip 89 in the orifice 88 ensures that the tip is exposed to turbulent flow. It should be noted that water passes through the chamber 76 both during sampling of the water and during any more prolonged blow down to reduce the level of total dissolved solids in the water. In some circumstances a user may wish to reverse the flow of water through the chamber 76 and in this case the apertured plate 90 is effective in promoting turbulence in the chamber, especially in the vicinity of the tip 89 of the probe 74.

As a result of the steps referred to above, an especially accurate measurement of total dissolved solids can be obtained.

The TDS probe 74 can be calibrated in a variety of ways. For example, during operation of the boiler a sample of water can be taken and passed both through the probe 74 and into the sample cooler 80 (FIG. 2). The reading from the probe 74 can be taken and stored together with a reading of the temperature of the water. The water in the sample cooler 80 can then be cooled to 25° C. and the amount of total dissolved solids in that water measured using a hand held portable instrument, for example the type H198312 instrument manufactured by "Hanna Instruments". By comparing the reading from the probe 74 with the reading at 25° C. the probe 74 can be calibrated. If desired, the calibration step can be repeated. If preferred, the probe 74 can also be calibrated automatically under the control of the control unit 1.

Whilst one particular embodiment of the invention has been described, it will be understood that many variations are possible. As one example of such a variation, the probe 74 may be mounted horizontally rather than vertically as shown in FIG. 2.

What is claimed is:

1. A method of controlling the operation of a pressurised steam boiler heated by a burner, the method including the following steps:

a) monitoring the level of total dissolved solids in water contained in the boiler, b) monitoring the level of water in the boiler, c) monitoring the pressure of steam in the boiler, d) monitoring the firing rate of the burner, e) controlling blow down of the boiler having regard to the signals resulting from a), f) controlling the flow rate of water into the boiler, and g) controlling the firing rate of the burner, all input signals relating to the monitoring steps being passed to the common control unit and all output signals relating to the controlling steps being transmitted from the common control unit.

2. A method according to claim 1, in which the amount of blow down of the boiler is controlled according to the firing rate of the burner.

3. A method according to claim 2, in which the amount of blow down of the boiler is approximately proportional to the firing rate of the burner.

4. A method according to claim 2, in which the amount of blow down of the boiler is varied by altering the standard time interval between blow downs.

5. A method according to claim 1, in which blow down of the boiler is inhibited until the pressure of steam in the boiler reaches a predetermined level.

6. A method according to claim 1, in which the step of monitoring the level of total dissolved solids in water in the boiler includes the step of measuring the temperature of the water contained in the boiler, and assessing the level of total dissolved solids having regard to the temperature of the water in the boiler.

7. A method according claim 1, in which the step of monitoring the level of total dissolved solids in water in the boiler includes the step of measuring the conductivity of a sample of water in the boiler.

8. A method according to claim 7, in which the conductivity of the water is measured using pulses of electrical energy that are emitted only for a proportion of the time during which the conductivity measurement is being made.

9. A method according to claim 8, in which the pulses include both positive and negative pulses.

10. A method according to claim 7, in which the step of monitoring the level of total dissolved solids in water in the boiler includes the step of measuring the degree of polarisation of the sample of water whose conductivity is measured and taking the polarisation measurement into account in the assessment of the level of total dissolved solids.

11. A method according to claim 1, in which the step of monitoring the level of total dissolved solids in water contained in the boiler includes the step of removing a sample of water from the boiler.

12. A method according to claim 11, in which water is removed from the boiler and passed along a conduit through a water sampling probe assembly.

13. A method according to claim 12, in which the water sampling probe assembly receives surface blow down water from the pressurised steam boiler.

14. A method according to claim 12, in which water flow through the water sampling probe assembly is turbulent and effects a cleaning action on the water sampling probe assembly.

15. A method according to claim 1, in which the assessment of the level of total dissolved solids is made having regard to the measurement of the pressure of steam in the boiler.

16. A method according to claim 1, in which, when the indication of the level of total dissolved solids in the water contained in the boiler exceeds a predetermined maximum value, a boiler blow down sequence is commenced.

17. A method according to claim 1, in which the level of total dissolved solids in the water contained in the boiler is monitored periodically.

18. A pressurised steam boiler including:

a boiler housing for containing water in a boiler, a burner for heating water in the boiler and converting the water into steam, a total dissolved solids detector for monitoring the level of total dissolved solids in the water in the boiler, a water level detector for monitoring the level of water in the boiler, a pressure detector for detecting the pressure of steam in the boiler, a firing rate detector for detecting the firing rate of the burner, and a common control unit which receives input signals from the total dissolved solids detector, the water level detector, the pressure detector and the firing rate detector, and is operative to control the flow rate of water into the boiler, blow down of the boiler and the firing rate of the burner in dependence upon said input signals.

19. A pressurised steam boiler according to claim 18, in which the control unit is arranged to control the amount of blow down of the boiler according to the firing rate of the burner.

20. A pressurised steam boiler according to claim 19, in which the control unit is arranged to control the amount of blow down of the boiler to be approximately proportional to the firing rate of the burner.

21. A pressurised steam boiler according to claim 19, in which the control unit is arranged to control the amount of blow down of the boiler by altering the standard time interval between blow downs.

22. A pressurised steam boiler according to claim 18, in which the control unit is arranged to inhibit blow down of the boiler until the pressure of steam measured by the pressure detector reaches a predetermined level.

23. A pressurised steam boiler according to claim 18, further including a temperature detector for detecting the temperature of the water contained in the boiler, the signal from the total dissolved solids detector being arranged to be modified in dependence upon the temperature measurement.

24. A pressurised steam boiler according to claim 18, in which the total dissolved solids detector comprises a conductivity detector for measuring water conductivity.

25. A pressurised steam boiler according to claim 24, in which the conductivity detector is arranged to emit pulses of electrical energy only for a proportion of the time during which the conductivity measurement is being made.

26. A pressurised steam boiler according to claim 25, in which the pulses include both positive and negative pulses.

27. A pressurised steam boiler according to claim 24, further including a detector for measuring the degree of polarisation of the water whose conductivity is to be measured, the signal from the total dissolved solids detector being arranged to be modified in dependence upon the polarisation measurement.

28. A pressurised steam boiler according to claim 18, in which the total dissolved solids detector is arranged to monitor the level of total dissolved solids in a sample of water in a water sampling probe assembly connected to the interior of the boiler housing by a conduit.

29. A pressurised steam boiler according to claim 28, in which the water sampling probe assembly is arranged to receive surface blow down water from the pressurised steam boiler.

30. A pressurised steam boiler according to claim 28, in which the water flow through the water sampling probe assembly is arranged to be turbulent and to effect a cleaning action on the water sampling probe assembly.

31. A pressurised steam boiler according to claim 18, in which the signal from the total dissolved solids detector is arranged to be modified in dependence upon the measurement of the pressure of the steam in the boiler.

32. A pressurised steam boiler according to claim 18, in which the boiler is controlled such that, when the indication of the level of total dissolved solids in the water in the boiler exceeds a predetermined maximum value, a boiler blow down sequence is commenced.

33. A pressurised steam boiler according to claim 18, in which the level of total dissolved solids of water contained in the boiler is arranged to be monitored periodically.

34. A method of controlling the operation of a pressurised steam boiler heated by a burner, the method including the following steps:

(a) measuring the conductivity of water contained in the boiler, and (b) assessing the level of total dissolved solids having regard to the results of the conductivity measurement, wherein the conductivity of the water is measured using pulses of electrical energy that are emitted only for a proportion of the time during which the conductivity measurement is being made.

35. A method according to claim 34, in which the pulses of electrical energy are emitted for less than 10% of the time during which the conductivity measurement is being made.

36. A method according to claim 34, in which the pulses include both positive and negative pulses.

37. A method of controlling the operation of a pressurised steam boiler heated by a burner, the method including the following steps:

(a) measuring the conductivity of water contained in the boiler, (b) measuring the degree of polarisation of the water whose conductivity is measured, and (c) assessing the level of total dissolved solids having regard to the conductivity and polarisation measurements.

38. A method of controlling the operation of a pressurised steam boiler heated by a burner, the method including the following steps:

(a) providing a water sampling probe assembly for measuring total dissolved solids, the probe assembly being connected to receive water contained in the boiler via a conduit, (b) passing water from the boiler through the water sampling probe assembly, and (c) using the water sampling probe assembly to measure the conductivity of the water passing through the assembly, wherein the water flow through the water sampling probe assembly is turbulent and effects a cleaning action on the water sampling assembly.

39. A pressurised steam boiler including:

a boiler housing for containing water in a boiler, a burner for heating water in the boiler and converting the water into steam, and a conductivity detector for measuring water conductivity, wherein the conductivity detector is arranged to emit pulses of electrical energy only for a proportion of the time during which the conductivity measurement is being made.

40. A pressurised steam boiler according to claim 39, in which the conductivity detector is arranged to emit pulses of electrical energy only for less than 10% of the time during which the conductivity measurement is being made.

41. A pressurised steam boiler according to claim 39, in which the pulses include both positive and negative pulses.

42. A pressurised steam boiler including:

a boiler housing for containing water in a boiler, a burner for heating water in the boiler and converting the water into steam, a conductivity detector for measuring water conductivity, and a polarisation detector for measuring the degree of polarisation of the water whose conductivity is to be measured, wherein the signal from the conductivity detector is arranged to be modified in dependence upon the polarisation measurement to provide an indication of total dissolved solids in the water.

43. A pressurised steam boiler including:

a boiler housing for containing water in a boiler, a burner for heating water in the boiler and converting the water into steam, and a water sampling probe assembly connected to the interior of the boiler housing by a conduit for measuring the total dissolved solids of water contained in the boiler, wherein the water flow through the water sampling probe assembly is arranged to be turbulent and to effect a cleaning action on the water sampling probe assembly.

* * * * *